US011484059B2

(12) United States Patent
Balder et al.

(10) Patent No.: US 11,484,059 B2
(45) Date of Patent: Nov. 1, 2022

(54) VAPORIZER FILTER

(71) Applicant: Healthier Choices Management Corp., Hollywood, FL (US)

(72) Inventors: Edwin Balder, Mesa, AZ (US); Gilbert Cyphert, Phoenix, AZ (US); Daniel Julia, Phoenix, AZ (US)

(73) Assignee: HEALTHIER CHOICES MANAGEMENT CORP., Hollywood, FL (US)

( * ) Notice: Subject to any disclaimer, the term of this patent is extended or adjusted under 35 U.S.C. 154(b) by 349 days.

(21) Appl. No.: 16/526,729

(22) Filed: Jul. 30, 2019

(65) Prior Publication Data

US 2021/0030058 A1 Feb. 4, 2021

(51) Int. Cl.

| | |
|---|---|
| ***A24D 3/06*** | (2006.01) |
| ***A24D 3/16*** | (2006.01) |
| ***A24F 7/04*** | (2006.01) |

(52) U.S. Cl.

CPC ..... *A24F 7/04* (2013.01); *A24D 3/061* (2013.01); *A24D 3/062* (2013.01); *A24D 3/16* (2013.01)

(58) Field of Classification Search

None

See application file for complete search history.

(56) References Cited

PUBLICATIONS

Lee, Y.-S.; Kim, K.-H.; Lee, S.S.; Brown, R.J.C.; Jo, S.-H. Analytical Method for Measurement of Tobacco-Specific Nitrosamines in E-Cigarette Liquid and Aerosol. Appl. Sci. 2018, 8, 2699. https://doi.org/10.3390/app8122699 access Jan. 18, 2022 via https://www.mdpi.com/2076-3417/8/12/2699 (Year: 2018).*

* cited by examiner

*Primary Examiner* — Michael J Felton

(74) *Attorney, Agent, or Firm* — Geoffrey Lottenberg; Berger Singerman LLP

(57) ABSTRACT

A filter for an vaporizer has a housing having a sidewall and a top. A filter element is contained in the housing adjacent to the top. The filter element has an outer element concentrically arranged around an inner element. The outer element contains elongated fibrous filtering members containing quartz wool in order to reduce heavy metals contained in vapor passing through the filter. The inner element contains and delivers to the user flavorings or medications. A removable sanitary wrapper is disposed around the housing of the filter. The filter may also be configured as a replacement mouthpiece for a vaporizer.

15 Claims, 7 Drawing Sheets

VAPORIZER FILTER

CROSS REFERENCE TO RELATED APPLICATIONS

N/A

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the vaporizer filter of the present invention. It will be apparent, however, to one skilled in the art that the vaporizer filter may be practiced without some of these specific details. Throughout this description, the embodiments and examples shown should be considered as exemplars, rather than as limitations on the vaporizer filter. That is, the following description provides examples, and the accompanying drawings show various examples for the purposes of illustration. However, these examples should not be construed in a limiting sense as they are merely intended to provide examples of the vaporizer filter rather than to provide an exhaustive list of all possible implementations of the vaporizer filter.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
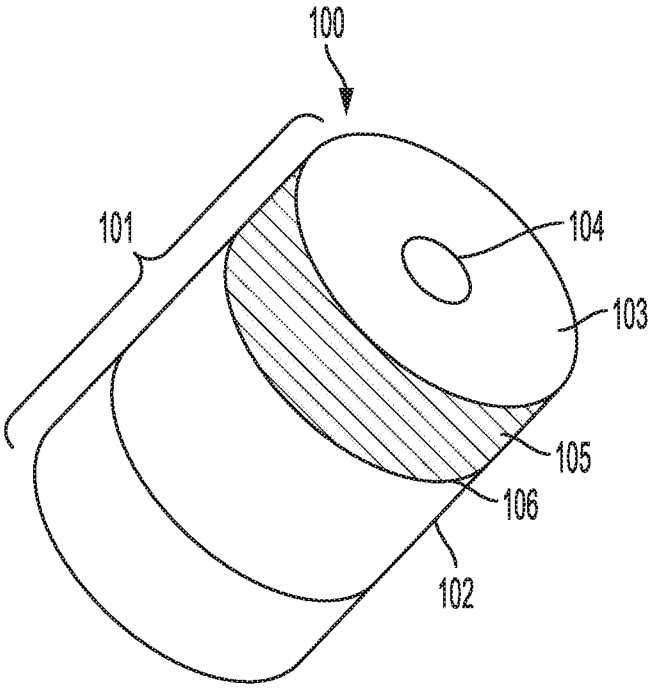
FIG. 1 is a perspective cutaway view of one embodiment of a filter embodying the principals of the invention.

Referring now to FIG. 1, shown is a removable filter 100 configured for use in conjunction with an vaporizer such as an electronic cigarette, vaporizer, or vaporizer component such as a pod, cartridge, or the like. The filter 100 is designed to be placed over the end of the vaporizer where the air flow outlet is located. In some embodiments, the filter 100 is configured to be placed over the mouthpiece or mouthpiece-area of such an vaporizer.

The filter 100 includes a housing 101 that has a sidewall 102 and a top 103. A filter element 105 is disposed inside the filter 100 adjacent to the top 103. In some embodiments, a partition 106 is provided on the opposite side of the filter element 105 in order to keep the filter element 105 in place. Thus, in some embodiments the filter element is disposed between top 103 and partition 106

In some embodiments, each of the top 103 and partition 106 includes an aperture 104 to permit air and vapor to pass from the vaporizer and out through the filter 100 into the user's mouth. The aperture 104 can also function as a drainage or blow-out hole for the user to expel from the filter 100 moisture that may build up inside the filter element 105 over time. In other embodiments, the top 103 and/or partition 106 are each generally air-permeable to facilitate airflow. In some embodiments, the interior of the filter 100 includes a lip or race 107 that facilitates a snap fit with an vaporizer as further described herein.

The housing 101 in some embodiments comprises a flexible material such as silicone or the like which permits the housing 101 to confirm to variances in the geometry of the mouthpiece over which it is placed. In other embodiments, the housing 101 is a rigid plastic or resin material that instead of being placed over the mouthpiece of a vaporizer, instead form the mouthpiece itself, which the filter element 105 embedded therein. Such an integrated design could be implemented as a removable mouthpiece element or as a fixed mouthpiece element such as may be the case in a disposable "pod" type vaporizer system. Yet still, in some embodiments, the filter element 105 may be removable and replaceable with respect to the housing 101 so that the housing 101 can be re-used repeatedly simply by replacing the filter element 105.

Figure 2:
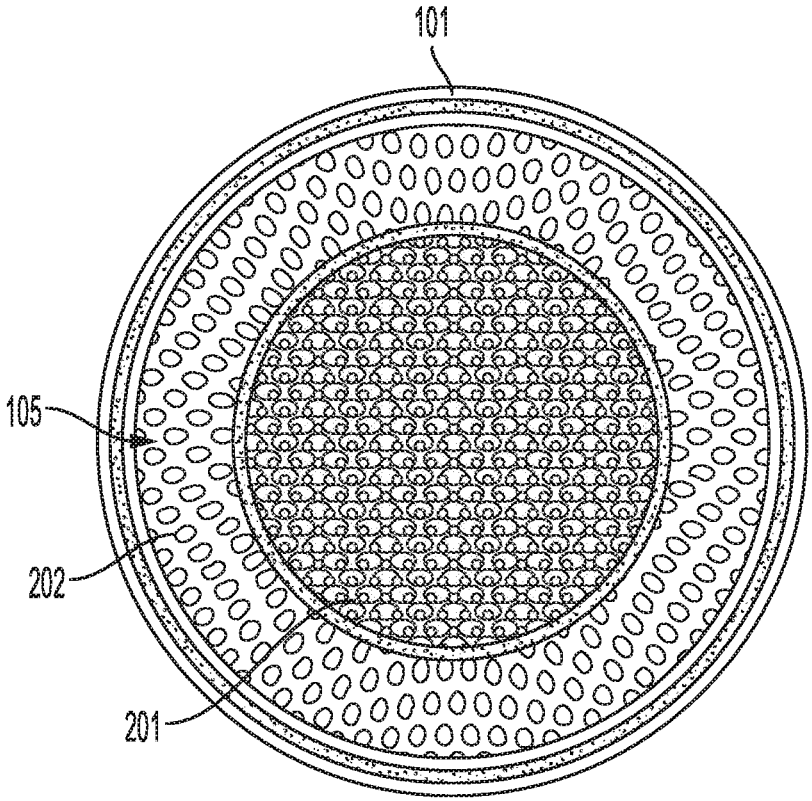
FIG. 2 is an end view of a filter element that may be included in the filter.

With reference to FIG. 2, in some embodiments, the filter element 105 of the filter 100 includes an inner element 201 and an outer element 202 concentrically disposed to one another. One or both of the inner and outer elements 201 and 202 may be constructed of microfibers or other materials made of any polyester, polyamides, bamboo, coconut charcoal, wood or cellulose fibers or polymeric material that is capable of absorbing water or vapor, and/or that which is capable of being impregnated with a flavor or chemical compound. In some embodiments, one or both of the inner and outer elements 201 and 202 comprise quartz wool or other micronized forms of quartz which are capable of absorbing heavy metals and other toxins that are present in certain types of vapor emitted from common vaporizers.

In some embodiments, one or both of the inner and outer elements 201 and 202 may comprise filtration and pass through structures having a high surface area for contact with vapor passing there through, enabling the vapor to become enriched with nicotine, cannabinoids, flavors, and other blends, either alone or in combination.

In some embodiments, the outer element 202 may comprise a plurality of axially elongated fibrous filtering material members disposed concentrically to reduce the amount of water vapor carried into the lungs when inhaling vapors from the vaporizer on which the filter 100 is disposed, whether such vapor contains nicotine, cannabinoids, flavor, or medications. In other embodiments, the inner element 201 comprises a section capable of dispensing volatile ingredients including nicotine, cannabinoids, tobacco flavor, medications, and other flavoring. Reservoirs formed therein may be circular or noncircular in cross section. Absorbent material may be used to retain more volatiles within the inner element 201 to better wick the volatile vapors when vapor or air is drawn through the vaporizer. Drawing vapor or air through the inner element 201 transfers vapors to the user. Loading of any material into the inner or outer elements 201 or 202 may be accomplished via sprayer, direct injection or a gaseous atmosphere conductive to preserving nicotine. The fluid mechanic principles of adhesion, cohesion capillary action and surface tension which can cause a thin film may be used. The basic properties, components and applications may be exchanged between the inner and outer elements 201 and 202.

Figure 3A:
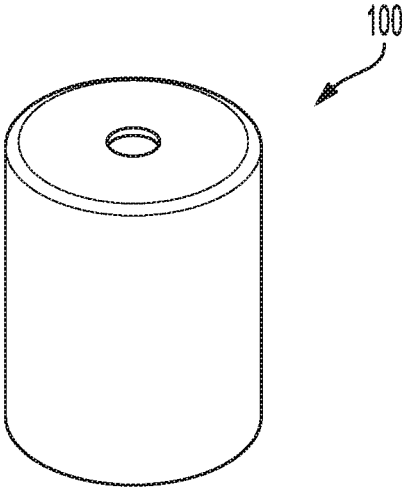
FIG. 3A is a perspective view of the filter in a cylinder configuration.
Figure 3B:
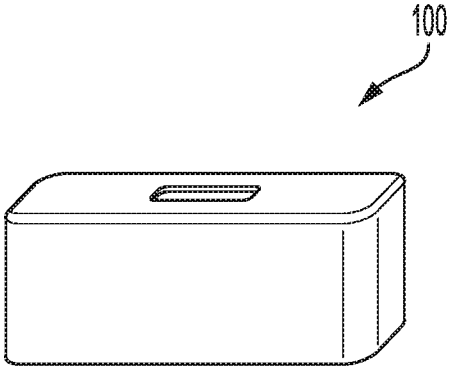
FIG. 3B is a perspective view of the filter in a rectangular configuration.
Figure 3C:
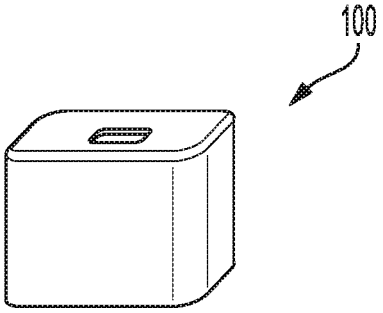
FIG. 3C is a perspective view of the filter in a square configuration.
Figure 3D:
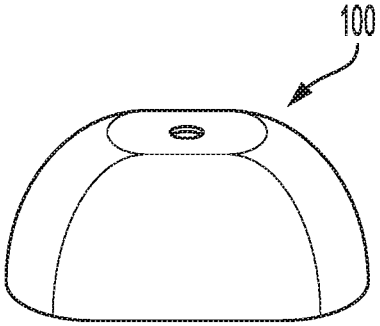
FIG. 3D is a perspective view of the filter in a conical configuration.

Referring to FIGS. 3A-3D shown are various embodiments of the filter shaped and sized to accommodate the geometry of various types of vaporizers and the mouthpieces thereof. FIG. 3A shows a generally cylindrical shaped filter 100. FIG. 3B shows a generally rectangular shaped filter 100. FIG. 3C shows a generally square shaped filter 100. FIG. 3D shows a generally conical or truncated-conical shaped filter 100.

Figure 4A:
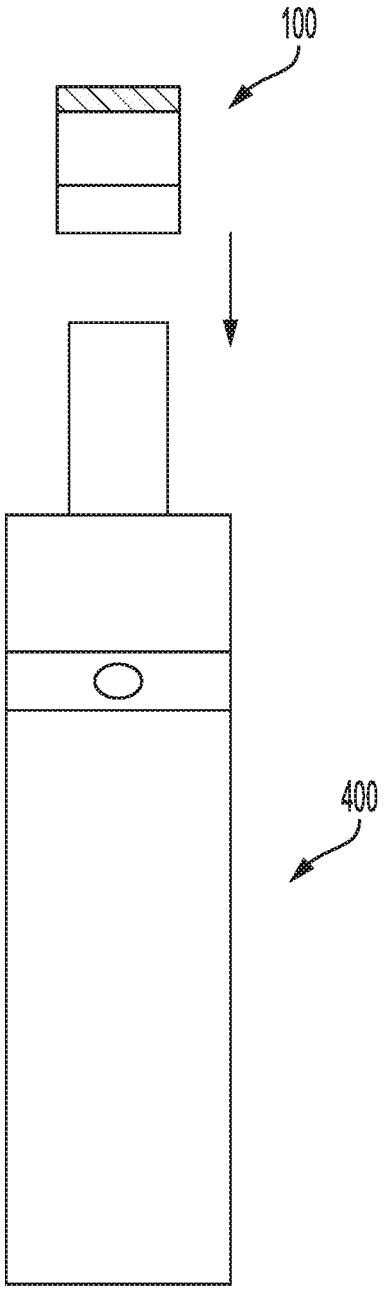
FIG. 4A is a perspective view of the filter in use in conjunction with an exemplary vaporizer.
Figure 4B:
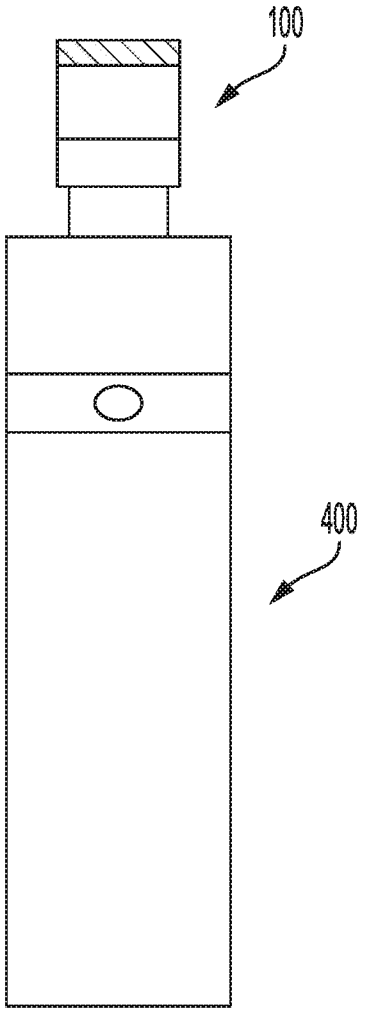
FIG. 4B is a perspective view of the filter in use in conjunction with an exemplary vaporizer.

Referring to FIGS. 4A and 4B shown is an exemplary embodiment of the filter 100 in use in conjunction with an exemplary vaporizer 400. The filter 100 may attached to the vaporizer 400 by interference fit or by snap fit. In some embodiments, the lip 107 engages with the top edge of the vaporizer to facilitate a secure, but removable fitment.

Figure 5:
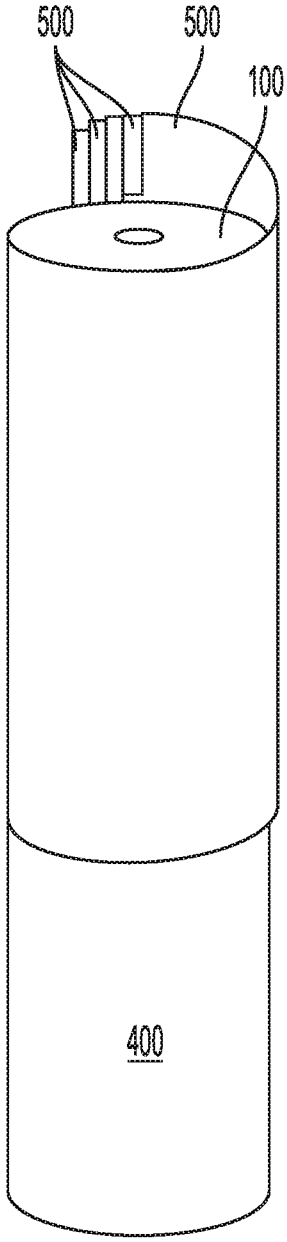
FIG. 5 is a view of an vaporizer showing a peel-away wrapper tip in combination with the filter.

Referring to FIG. 5, another feature of the filter 100 is illustrated. A removable wrapper 500 may disposed around the outside surface of the filter 100, where a user would place their lips when drawing on the vaporizer 400. In some embodiments, a series of sanitary peel-away wrappers 500 are concentrically disposed around the filter 100 and can be removed as desired to provide for a clean surface each time the vaporizer is used. In some embodiments the wrappers 500 are at least partially adhesive and are frangibly separated from one another by perforations, a kiss-cut, or separation line.

Figure 6A:
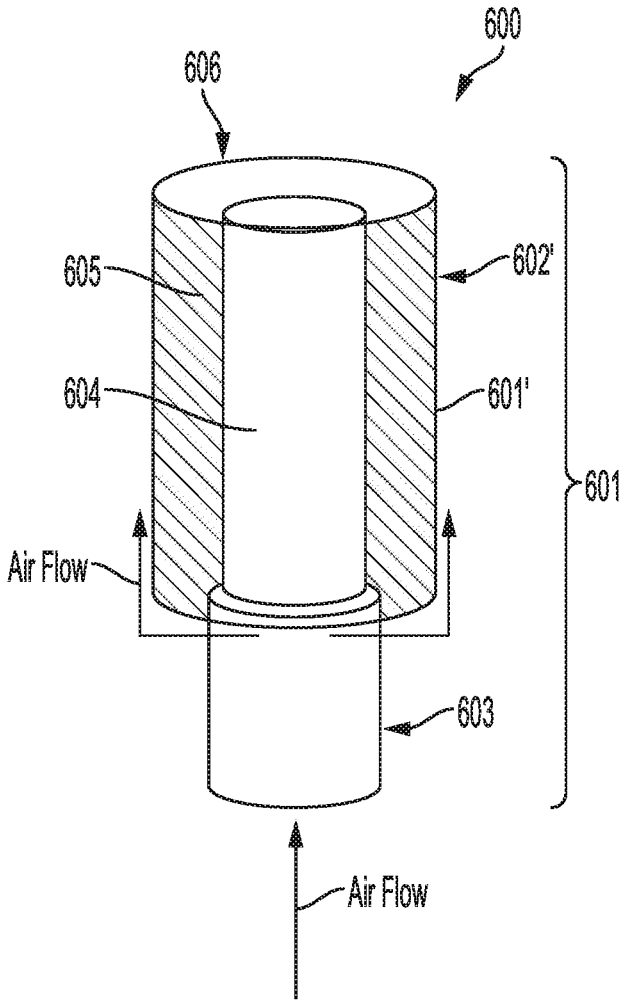
FIG. 6A is a perspective view of the filter configured as a mouthpiece.
Figure 6B:
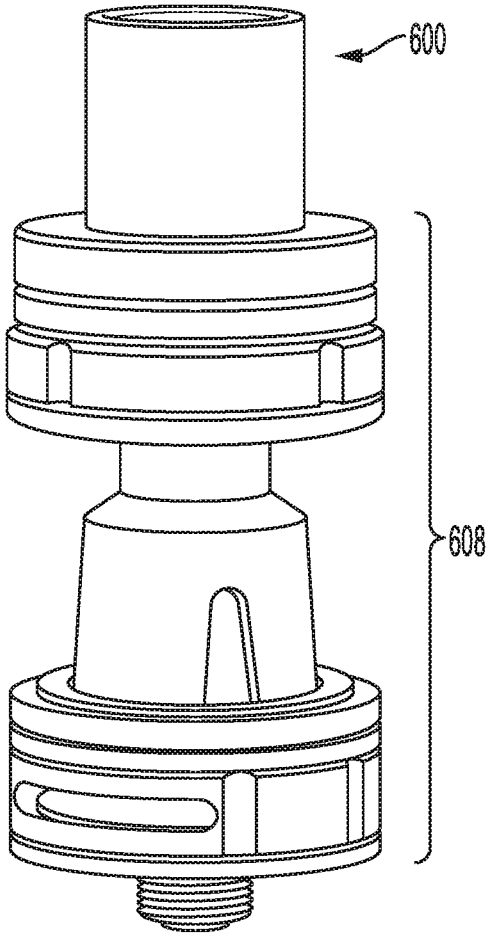
FIG. 6B is a perspective view of the filter configured as a mouthpiece installed on a vaporizer cartridge.

Referring to FIG. 6A, shown is an embodiment of the vaporizer filter configured as a removable and replaceable mouthpiece assembly for a vaporizer. Here, filter 600 comprises an outer housing 601 that includes a filter section 602 and a insert tang section 603 extending therefrom. The insert tang section 603 is hollow and is configured to be inserted and seated inside an opening of a vaporizer cartridge or similar vaporizer device. The filter section 602 includes an internal plug 604 oriented at the center of the filter housing 601. A filter element 605 is disposed annularly around the outside of the internal plug 605 and is encased by the sidewall 601' of the housing 601. Accordingly, the filter elements 605 is disposed between the sidewall 601' and the internal plug 605. A top 606 seals a portion of the filter section 602 and includes an aperture 607 to permit the passage of air flow out of the filter 600 and into the user's mouth. As shown in FIG. 6B, the filter 600 is seated in the vaporizer cartridge 608 and is in flow communication with the air flow exit thereof. In use, airflow is directed out of the vaporizer cartridge and into and through the insert tang 603. As air flow reaches the bottom of the filter section 602, the internal plug 604 blocks and re-directs airflow outward to the filter element 605 surrounding the plug 604. Accordingly, in some embodiments air flow passes only through the outer annulus, i.e. the filter element 605, and is filtered thereby. Filtered air exits through the aperture 607 of the top 606. The filter element 600 may comprise all of the elements disclosed above with respect to filter element 105.

It is appreciated and understood that the term vaporizer as used herein is exemplary of an inhalation devices that can be used to combust or vaporize liquids, concentrates, waxes, solid materials, herbs, tobacco, and the like.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A filter for an vaporizer, comprising:

a housing having a sidewall and a top;

a filter element disposed in the housing adjacent to the top;

wherein the filter element and the top are air permeable;

wherein the filter element includes an inner element concentrically disposed inside an outer element; and wherein at least a portion of the filter element comprises quartz wool configured to reduce heavy metals contained in vapor passing therethrough.

2. The filter of claim 1, including a partition disposed in the housing wherein the filter element is disposed between the partition and the top.

3. The filter of claim 1, including a lip disposed inside the housing configured to provide a snap-fit onto an vaporizer.

4. The filter of claim 1, wherein the outer element comprises a plurality of axially elongated fibrous filtering members configured to reduce the amount of water vapor passing through the filter element.

5. The filter of claim 1, wherein the inner element comprises a plurality of reservoirs containing flavoring.

6. The filter of claim 1, wherein the inner element comprises a plurality of reservoirs containing medications.

7. The filter of claim 1, including a removable sanitary wrapper disposed around the housing.

8. A filter for an vaporizer, comprising:

a housing having a sidewall and a top;

a filter element disposed in the housing adjacent to the top;

wherein the filter element and the top are air permeable;

wherein the filter element comprises an outer element concentrically disposed around an inner element;

wherein the outer element comprises a plurality of axially elongated fibrous filtering members containing quartz wool configured to reduce heavy metals contained in vapor passing therethrough; and wherein the inner element comprises flavorings or medications.

9. The filter of claim 8, including a partition disposed in the housing wherein the filter element is disposed between the partition and the top.

10. The filter of claim 8, including a lip disposed inside the housing configured to provide a snap-fit onto an vaporizer.

11. The filter of claim 8, including a removable sanitary wrapper disposed around the housing.

12. The filter of claim 8, wherein the housing is cylindrical.

13. The filter of claim 8, wherein the housing is rectangular.

14. The filter of claim 8, wherein the housing is square.

15. The filter of claim 8, wherein the housing is conical.

* * * * *